US007557682B2

(12) United States Patent
Ricciuti et al.

(10) Patent No.: US 7,557,682 B2
(45) Date of Patent: Jul. 7, 2009

(54) INERTIAL SOLENOID DELAY FOR THE OPENING OF MEDIUM VOLTAGE CIRCUIT BREAKERS

(75) Inventors: Anthony Thomas Ricciuti, Bethel Park, PA (US); Mark Allan Juds, New Berlin, WI (US); John Joseph Hoegle, Beaver, PA (US); Thomas Kenneth Fogle, Pittsburgh, PA (US); Robert Nicklos Krevokuch, West Newton, PA (US); Russel William Long, Pittsburgh, PA (US); Daniel Evan Palmieri, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 215 days.

(21) Appl. No.: 11/565,671

(22) Filed: Dec. 1, 2006

(65) Prior Publication Data

US 2008/0129429 A1 Jun. 5, 2008

(51) Int. Cl.
*H01H 7/08* (2006.01)
*H01H 43/08* (2006.01)

(52) U.S. Cl. ..... 335/64; 335/6; 335/28; 335/39; 335/53; 335/59; 335/218; 335/239; 335/60; 335/61; 335/62; 335/63

(58) Field of Classification Search ..... 335/6, 335/28, 39, 53, 59–64, 218, 239
See application file for complete search history.

(56) References Cited

U.S. PATENT DOCUMENTS

| | | | | |
|---|---|---|---|---|
| 2,904,730 | A * | 9/1959 | Peek | 335/239 |
| 3,019,315 | A * | 1/1962 | Wolf | 335/6 |
| 3,129,358 | A * | 4/1964 | Harbaugh et al. | 361/73 |
| 4,382,270 | A * | 5/1983 | Davidson et al. | 361/115 |
| 4,636,760 | A * | 1/1987 | Lee | 335/14 |
| 4,725,799 | A * | 2/1988 | Bratkowski et al. | 335/14 |
| 4,743,876 | A | 5/1988 | Milianowicz et al. | |
| 5,093,643 | A * | 3/1992 | Altenhof et al. | 335/20 |
| 6,285,270 | B1 * | 9/2001 | Lane et al. | 335/6 |
| 6,486,758 | B1 | 11/2002 | Olszewski et al. | |
| 6,670,870 | B2 * | 12/2003 | Macbeth | 335/6 |
| 6,864,450 | B1 | 3/2005 | Chen et al. | |
| 7,009,473 | B2 * | 3/2006 | Zhang | 335/6 |
| 7,186,937 | B1 * | 3/2007 | Ricciuti et al. | 200/400 |
| 7,248,135 | B2 * | 7/2007 | Zindler | 335/6 |

* cited by examiner

*Primary Examiner*—Lincoln Donovan
*Assistant Examiner*—Mohamad A Musleh
(74) *Attorney, Agent, or Firm*—Martin J. Moran

(57) ABSTRACT

A solenoid assembly for a circuit breaker having a clapper with an increased mass is provided. The mass, preferably at least one non-ferrous slug, increases the mass of the clapper so that the solenoid response time is slowed. That is, the added mass creates an inertial delay that slows the solenoid clapper as the clapper moves between the first position and the second position. Preferably, the delay is between 48 ms and 60 ms, and more preferably 50 ms. The clapper having a non-ferrous slug may also be incorporated into existing circuit breakers by, for example, coupling the non-ferrous slug to the preexisting clapper, or replacing the clapper with a clapper assembly having at least one non-ferrous slug thereon.

20 Claims, 7 Drawing Sheets

INERTIAL SOLENOID DELAY FOR THE OPENING OF MEDIUM VOLTAGE CIRCUIT BREAKERS

BACKGROUND OF THE INVENTION

1. Field of the Invention

The present invention relates to a medium voltage switchgear having a circuit breaker, the circuit breaker having an operating mechanism with an opening solenoid and, more specifically, to an opening solenoid having additional mass coupled to the solenoid clapper, the additional mass structured to cause an inertial delay to the operation of the solenoid clapper.

2. Background Information

A medium voltage switchgear, typically, comprises a switching mechanism housed in an enclosure. The switching mechanism, typically a circuit breaker, includes a plurality of separable contacts coupled to an operating mechanism having a common spring-operated closing and tripping device. The operating mechanism includes one or more opening springs which separate the contact and a pair of closing springs which close the contacts as well as charge the opening spring. The separable contacts are closed by releasing the energy stored in the closing springs through activation of a closing trigger mechanism. This can be done manually or remotely through a solenoid. The closing springs are charged manually by a lever arm through a ratchet coupling, or, more preferably, by a motor. An electronic trip circuit monitors the load currents and actuates an opening trigger mechanism through an opening solenoid if the current exceeds certain current-time characteristics.

The opening solenoid includes an elongated clapper structured to move between a first position and a second position. The elongated clapper extends between the trip device and a trip lever in the operating mechanism. The clapper is, typically, made from steel. The trip lever is fixed to a D shaft that engages the operating mechanism trip latch. When the clapper is in the first position, the operating mechanism trip latch may engage the D shaft. When the trip latch is held by the D shaft, the separable contacts may be closed. Once the separable contacts are closed current may pass through the circuit breaker. If an external control device applies the appropriate voltage and current to the solenoid coil, or if the clapper is manually activated, the clapper moves to the second position. As the clapper moves into the second position, the clapper causes the trip lever to rotate which, in turn, causes the D shaft to rotate. As the D shaft rotates, the trip latch disengages from the D shaft and allows the operating mechanism to separate the contacts.

The opening solenoid has a mass limit. That is, the opening solenoid is structured to move a mass, the clapper, and that mass has a maximum limit. The higher the mass limit, the greater the mass the opening solenoid is structured to move. Generally, an opening clapper has a mass that is between 5% and 20% of the mass limit of an opening solenoid. For example, a typical opening solenoid has a mass limit of about 1.89 kg and a typical opening clapper has a mass of about 0.2 kg. In this configuration, the response time, that is the time to move the clapper between the first and second position, is about 10 ms to 35 ms, and more typically 25 ms. When the mass of the opening clapper is reduced, the response time, i.e., the time required for the clapper to move between first and second positions, of the opening solenoid is decreased. That is, with a lighter opening clapper, the opening solenoid clapper moves between the first and second positions more rapidly.

It is generally assumed that the response time of the opening solenoid should be as short as possible. That is, when the current exceeds certain current-time characteristics it is desirable to have the operating mechanism separate the contacts as quickly as possible to avoid, or minimize, damage to the circuit breaker and/or load side electrical components. To ensure that the operating mechanism responds rapidly, the opening solenoid must respond rapidly as well. However, it has also been determined that a typical over current, or "fault current," situation includes a decaying direct current as well as an alternating current. That is, a current, either direct or alternating, has a wave form that may be expressed, generally, as a sine wave. A decaying direct current occurs just after the direct current wave form is at a peak. It has further been determined that, if the contacts are separated at, or near, the maximum wave peak, i.e., both the direct and alternating currents are at or near their peaks, the contacts may be damaged. Given that the fault current typically occurs when the direct current is at, or just past, a peak, separation of the contacts at the maximum wave peak could be avoided if the separation of the contacts was delayed until the direct current was off peak.

There is, therefore, a need for an operating mechanism structured to delay the separation of the contacts until the direct current was off peak.

There is a further need for an opening solenoid that is structured to delay the movement of the clapper thereby delaying the release of the operating mechanism trip latch.

There is a further need for an opening solenoid that is structured to delay the movement of the clapper that may be incorporated into existing circuit breakers.

SUMMARY OF THE INVENTION

These needs, and others, are met by the device disclosed herein provides for a solenoid assembly with a clapper having mass coupled thereto. The mass, preferably at least one non-ferrous slug, increases the mass of the clapper so that the solenoid response time is slowed. That is, the added mass creates an inertial delay that slows the clapper as the clapper moves between the first position and the second position. Preferably, the delay is between 48 ms and 60 ms, and more preferably 50 ms. The clapper having a non-ferrous slug may also be incorporated into existing circuit breakers by, for example, coupling the non-ferrous slug to the preexisting clapper, or replacing the clapper with a clapper assembly having at least one non-ferrous slug thereon.

In an alternate embodiment, the clapper may simply be constructed to have a greater mass. For example, the clapper may be thicker, wider, or made from a material of greater density than 7.85 kg/dm$^3$. Such a change in size or material is not simply a design choice. That is, generally it is desirable to have smaller, lighter components on a circuit breaker. Smaller, lighter components typically provide a better response time. Smaller components further allow the circuit breaker to occupy a smaller space. Conversely, larger components and/or heavier materials are typically used to improve the strength of a component. The clapper, however, is not subjected to an excessive stress and, as such, the strength of the clapper is not typically a design issue. Therefore, an improvement to a clapper generally involves making a clapper lighter, smaller, or both. The improvement disclosed herein, however, relates to increasing the mass of the opening clapper.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
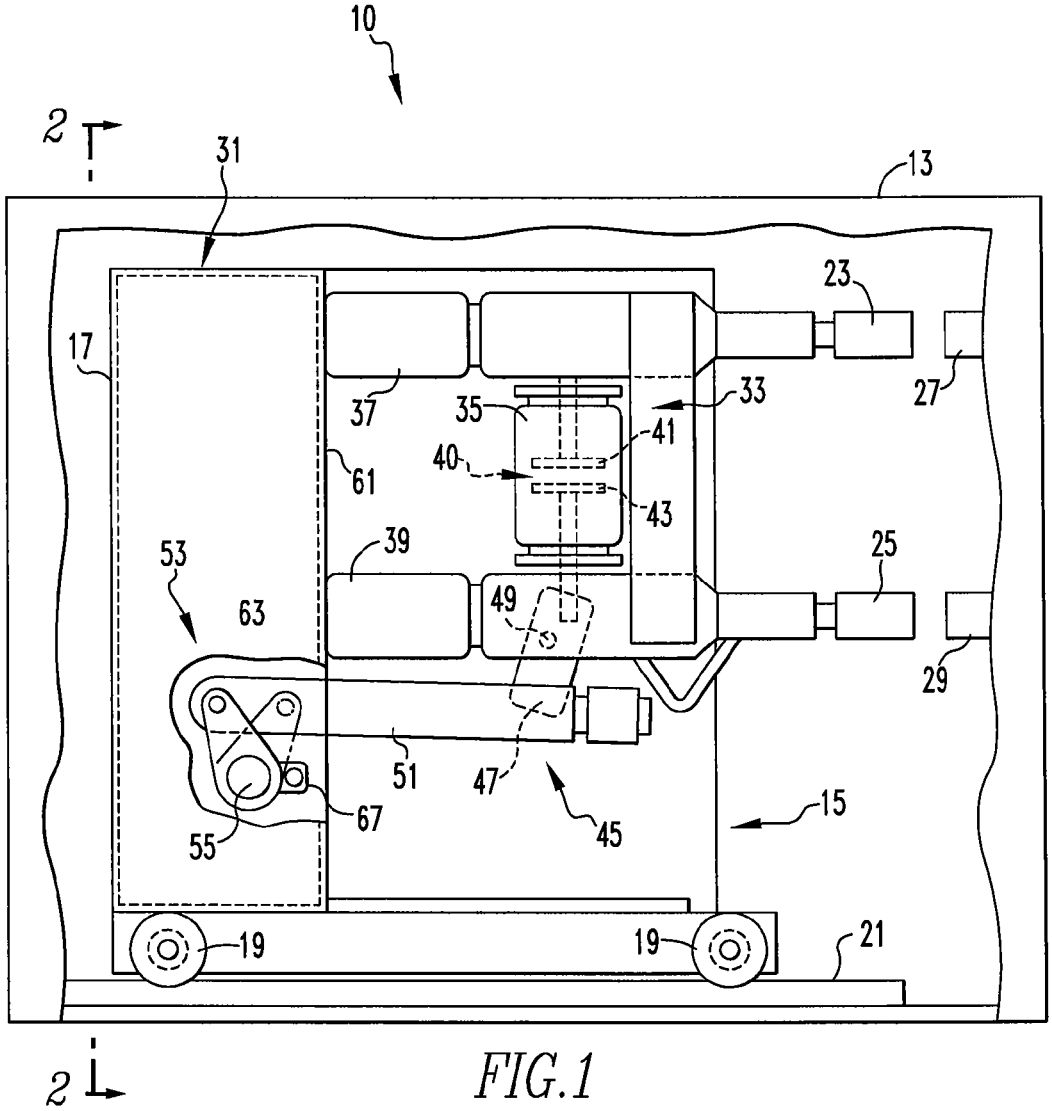
FIG. 1 is a side elevational view with some parts cut away with a typical medium voltage circuit breaker in accordance with the invention shown in the disconnected position.
Figure 2:
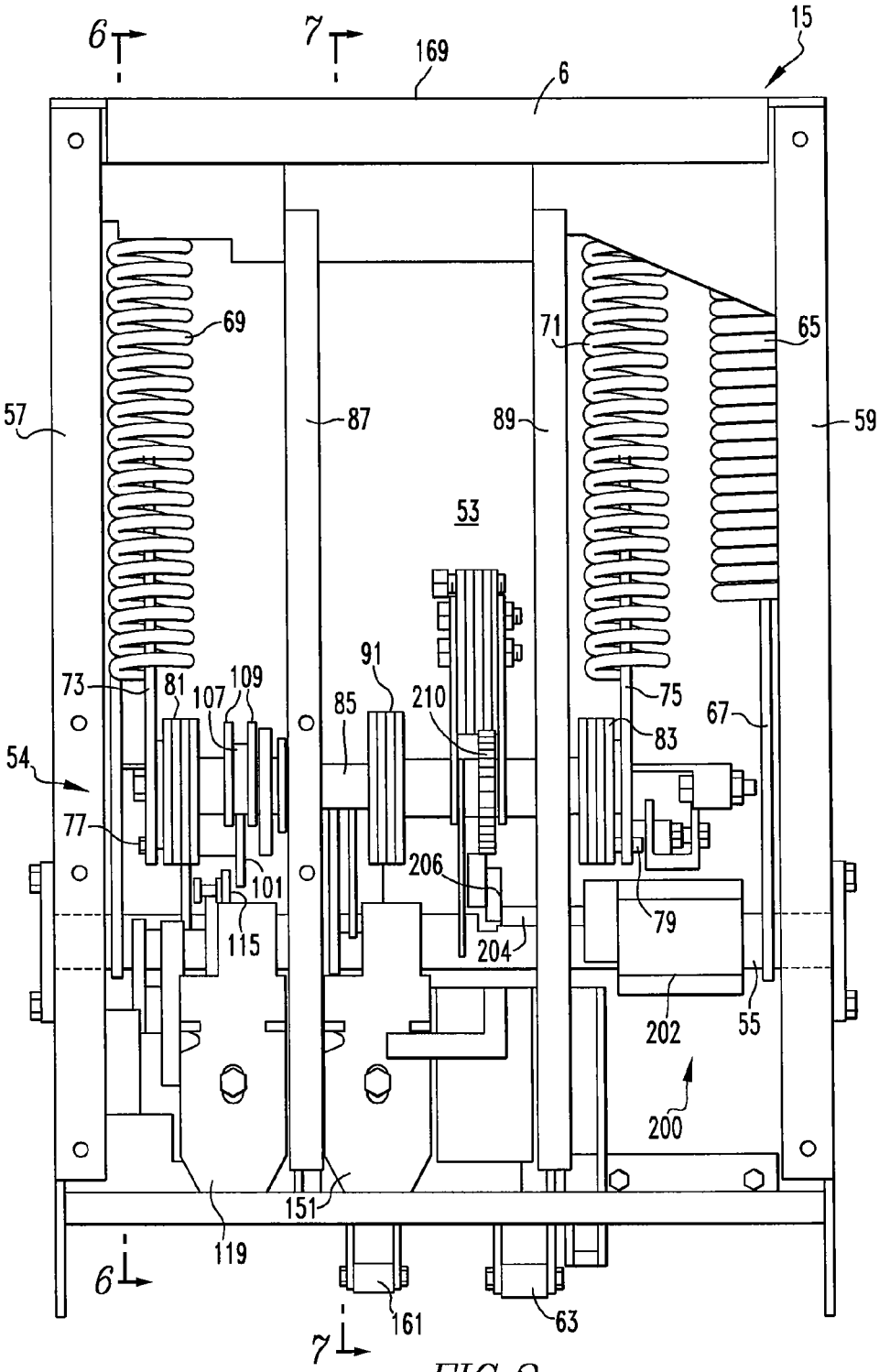
FIG. 2 is a front elevational view of a typical circuit breaker as seen in FIG. 1 with the cover removed.

As shown in FIGS. 1 and 2, a switch gear apparatus 10 includes a cabinet or enclosure 13 for enclosing a circuit breaker 15. The exemplary circuit breaker 15 is, preferably, a draw-out three-phase vacuum circuit interrupter having controls on a front panel 17 for manually operating the circuit breaker 15. The circuit breaker 15 has wheels 19 which engage rails 21 for inserting the circuit breaker 15 into and removing the circuit breaker 15 from the enclosure 13. The enclosure 13 includes at least one line terminal 27 and at least one load terminal 29. The circuit breaker 15 includes at least one line terminal 23 and at least one load terminal 25. Typically, the switch gear apparatus 10 has three circuit breaker line and load terminals 23, 25 and three corresponding enclosure line and load terminals 27, 29. The circuit breaker line and load terminals 23, 25 are positioned to engage, and be electrically coupled to, the enclosure line and load terminals 27, 29. Movement of the circuit breaker 15 along the rails 21 also effects connection and disconnection of circuit breaker line and load terminals 23, 25 with the enclosure line and load terminals 27, 29. While a medium voltage vacuum interrupter is shown for the circuit breaker 15, the invention is also applicable for use with air circuit breakers.

The circuit breaker 15 has a front low voltage section 31 adjacent to the front panel 17 and a rear high voltage section 33 containing a vacuum interrupter 35 for each phase. The low and high voltage sections 31, 33 are electrically insulated from each other by upper and lower insulators 37, 39. Within each vacuum interrupter 35, a pair of separable contacts 40 including a stationary contact 41 and a moveable contact 43 are provided. The contacts 40 are operated between the open position (shown) and a closed position by a linkage 45 which includes a bell crank 47 (shown schematically) pivoted at pivot point 49 and an insulated push rod 51 extending into the low voltage section 31.

An operating mechanism 53 for opening and closing the separable contacts 40 through the linkage 45 is contained in the low voltage section 31. This operating mechanism 53 has a number of driven parts 54 which include a pole shaft 55 which is rotatably journaled in sidewalls 57, 59 of a housing 61 (FIG. 2). A pole arm 63 (FIG. 1) for each phase projects laterally from the pole shaft 55 and is pivotally connected to the associated push rod 51 so that rotation of the pole shaft 55 simultaneously opens or closes the separable contacts 40 of each pole. The pole shaft 55 is rotated counter-clockwise as viewed in FIG. 1 to open the contacts 40 by an opening spring 65 in the form of a helical tension spring connected at one end to an upper portion of the housing 61 of the low voltage section 31 and at the other end to a lever arm 67 mounted on the pole shaft 55.

The operating mechanism 53 also includes a pair of helical tension closing springs 69, 71 each of which is connected at its upper end to the housing 61 and at its lower end through a spring link 73, 75 to an eccentric pivot 77, 79 on a spring crank 81, 83, respectively. The spring cranks 81, 83 are mounted on opposite ends of a crank shaft 85 rotatably supported between a pair of spaced supports 87, 89. Fixed on the crank shaft 85 between the supports 87, 89 is a closing cam 91 which includes a notch 93 in the peripheral cam surface thereof (see FIGS. 7*a-c*).

Figure 3:
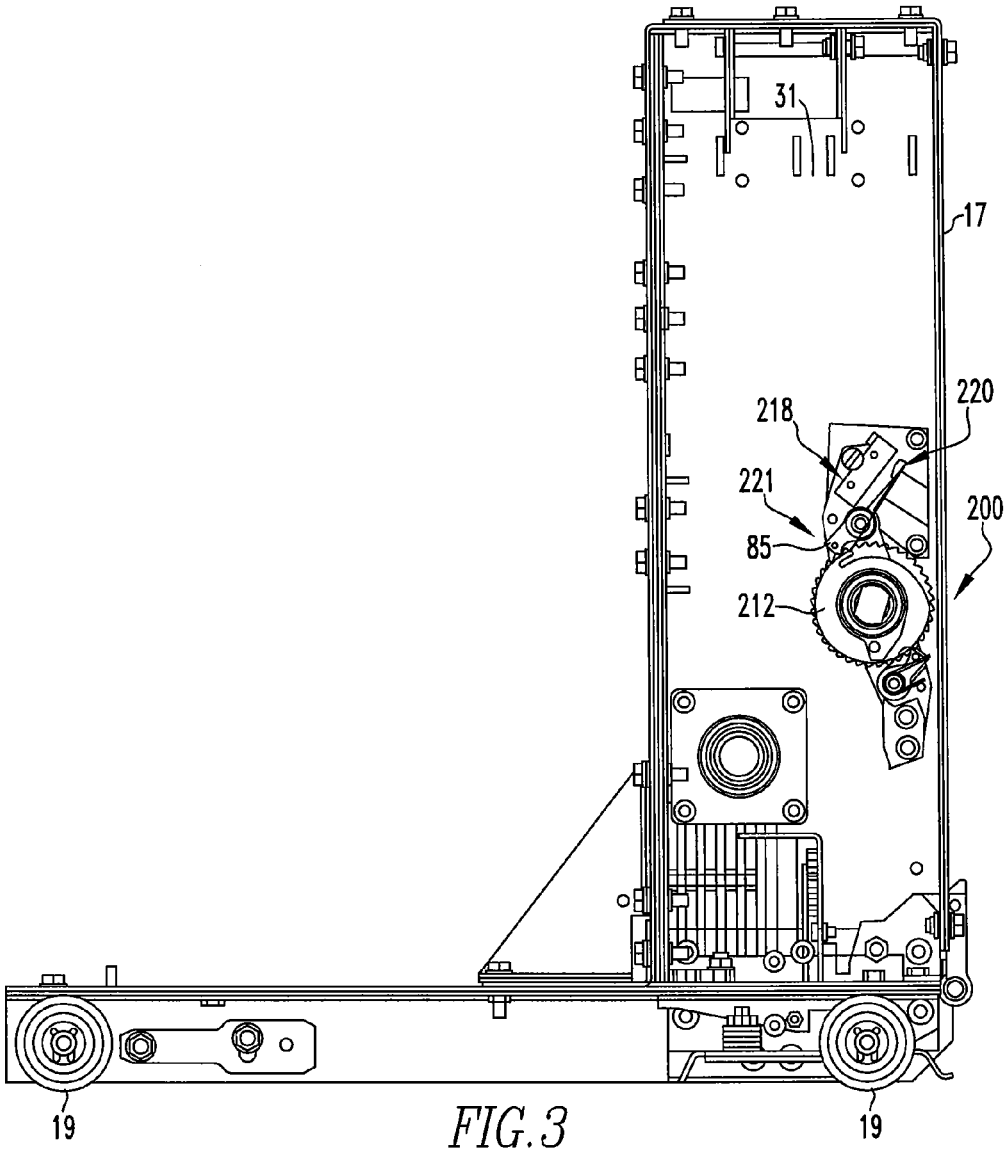
FIG. 3 is a partial side view of a circuit breaker.
Figure 4:
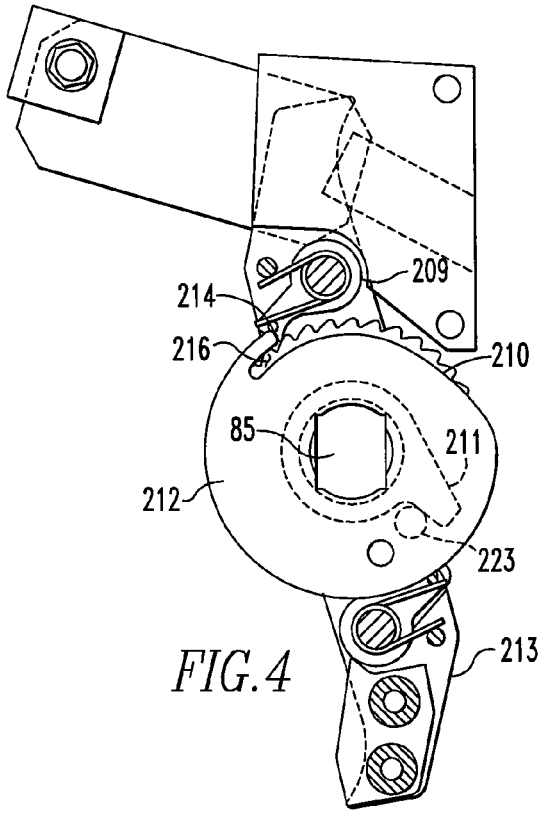
FIG. 4 is a detailed side view of a portion of the charging mechanism.
Figure 5:
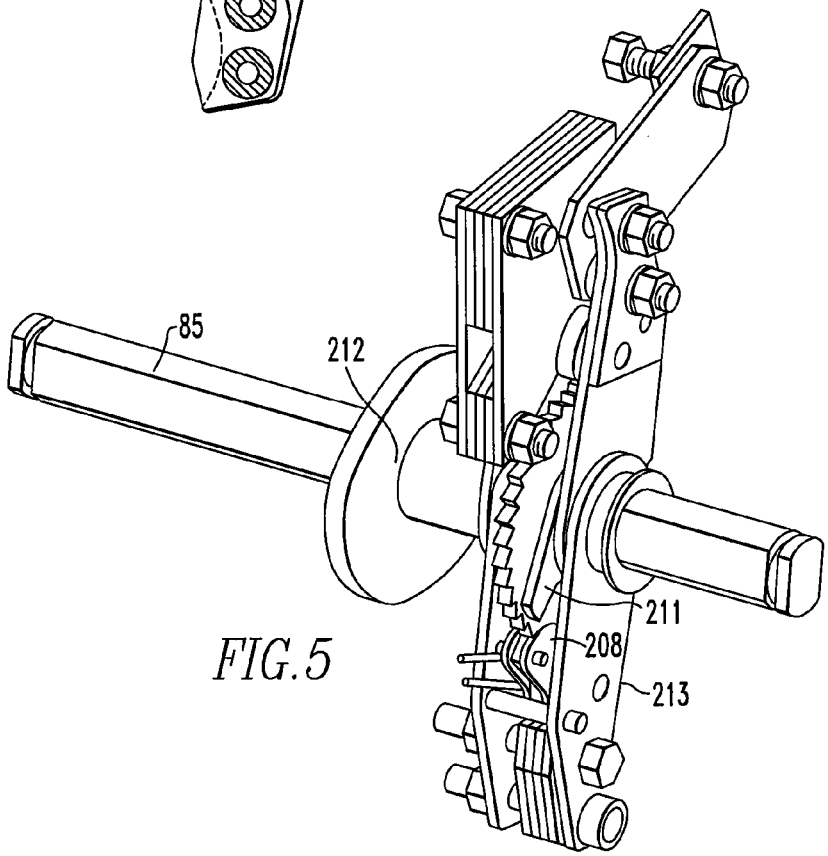
FIG. 5 is an isometric view of the charging mechanism shown in FIG. 4.

The crank shaft 85 is rotated to extend or charge the two closing springs 69, 71 by a charging mechanism 200. As shown in FIG. 2, the charging mechanism 200 includes a motor 202, preferably electric, having a motor shaft 204, and a drive gear eccentric 206. As further shown in FIGS. 3-5, the charging mechanism 200 further includes at least one charge pawl 208, at least one hold pawl 209 a ratchet wheel 210, at least one charging plate 211, at least one drive lever 213, a motor control cam 212, and a motor control switch 218 having a switch lever 220. The switch lever 220 is, preferably, a rectangular beam 221 having a diameter thickness between about 0.031 and 0.062 inch, and more preferably about 0.040 inch. The motor shaft 204 extends in a direction generally parallel to the crank shaft 85. The drive eccentric 206 is coupled to the motor shaft 204. The ratchet wheel 210 is fixedly mounted to freely rotate about the crank shaft 85 within rotational boundaries set by an integral detent 223 and at least one charging plate 211. The at least one charging plate 211 is fixedly mounted to the crank shaft 85. The charge pawl 208 is coupled to at least one drive lever 213, which in turn freely rotates about the crank shaft 85. The drive gear eccentric 206 is structured to operatively engage the ratchet wheel 210 through at least one drive lever 213 so that, when the motor 202 is energized, the crank shaft 85 is rotated counter-clockwise as shown by the arrows in FIGS. 7*a-c*. That is, rotation of the motor shaft 204 is transferred to the crank shaft 85 via the linking of the drive gear eccentric 206, the charge pawl 208, at least one drive lever 213, and the ratchet wheel 210. Reverse rotation of the crank shaft 85 is substantially limited by the at least one hold pawl 209 which is coupled to the housing 61 and also structured to engage the ratchet wheel 210.

The motor control cam 212 is also fixedly coupled to the crank shaft 85. The motor control switch 218 is coupled to the housing 61 adjacent to the motor control cam 212. The motor control switch lever 220 extends toward and engages the cam surface of the motor control cam 212. The motor control switch 218 is electrically coupled to the motor 202 and provides a control signal thereto. That is, the motor control switch 218 is structured to selectively actuate the motor 202 in response to the position of the switch lever 220. The switch lever 220 is structured to engage the motor control cam 212 and move in response to the changing diameter of the motor control cam 212. The motor control cam 212 includes a first, reduced diameter portion 230, and a second, wide diameter portion 232. The switch lever notch 214 is located at one boundary between the first, reduced diameter portion 230, and the second, wide diameter portion 232. The motor control switch 218 is structured to provide an actuation signal to the motor 202 when the motor control switch lever 220 engages the second, wide diameter portion 232 of the motor control cam 212. When the motor control switch lever 220 engages the first, reduced diameter portion 230 of the motor control cam 212 the motor 202 is not actuated.

Alternatively, as is known, the crank shaft 85 can be manually rotated to charge the closing springs 69, 71 by a charging lever (not shown) which engages the charging mechanism 200. The closing springs 69, 71 are retained in the charged condition and released by a first, closing spring release 99 (see FIGS. 6*a* and b) which includes a closing spring release latch 101 pivotally connected on a shaft 103. This closing spring release latch 101 has a latch surface 105 which is engaged by a latch roller 107 supported between a pair of roller support arms 109 fixed to the crank shaft 85.

Figure 6A:
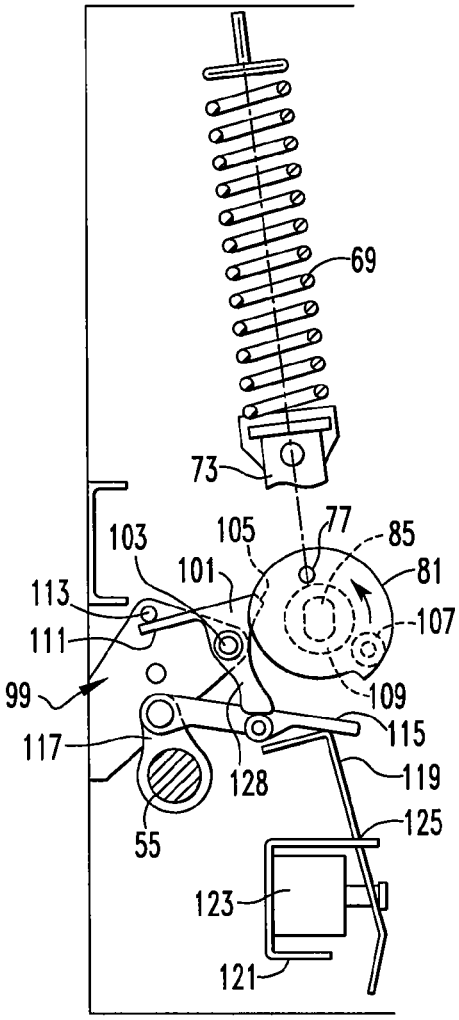
FIG. 6*a* is a sectional view taken along the line 6-6 in FIG. 2 shown with the breaker in the open position and the closing springs discharged.

With the circuit breaker 15 open and the closing springs 69, 71 discharged as shown in FIG. 6*a*, operation of the charging mechanism 200 causes the crank shaft 85 to rotate in a counterclockwise direction as shown by the arrow. This causes the eccentric pivots 77, 79 to move downward thereby extending the closing springs 69, 71. Just after the eccentric pivots 77, 79 carry the lines of action of the closing springs 69, 71 through the center of the crank shaft 85, the closing latch roller 107 engages the latch surface 105 on the closing spring release latch 101. The tendency of the closing springs 69, 71 to continue the rotation in the clockwise direction is blocked by the engagement of an extension 111 on the release latch 101 with a fixed pin 113.

Figure 6B:
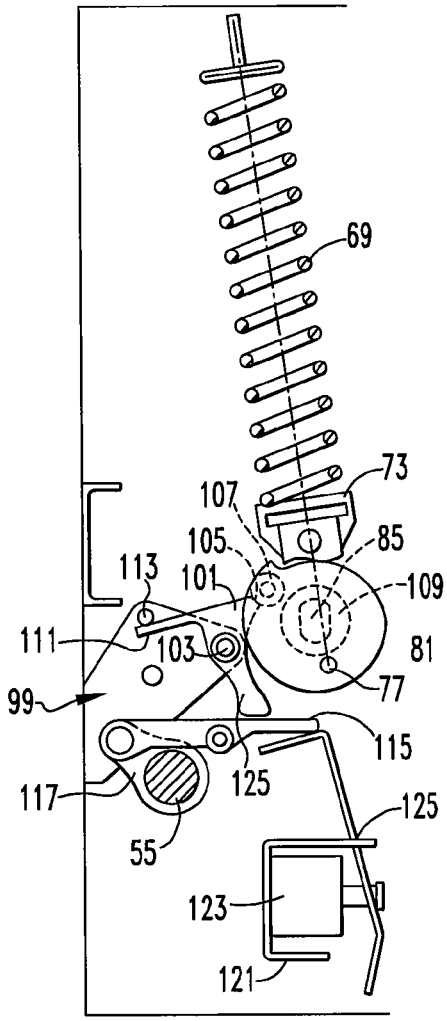
FIG. 6*b* is similar to FIG. 6*a* but showing the breaker closed with the closing springs charged.

The release latch 101 is operated by a release lever 115 pivotally connected at one end to an arm 117 on the pole shaft 55. The other end of the release lever 115 rests on a close clapper 119. The close clapper 119, in turn, is pivotally supported on a bracket 121 which also supports a close solenoid 123. Rotation of the close clapper 119 counterclockwise in FIG. 6*a* about a pivot axis 125, either manually by pressing on the lower end of the close clapper 119, or automatically by energization of the close solenoid 123, causes clockwise rotation of the release lever 115. The release lever 115 engages a projection 128 on the close spring release latch 101 which is rotated clockwise until the close latch roller 107 slips off of the latch surface 105. This permits the closing springs 69, 71 to rapidly rotate the crank shaft 85. This results in rotation of the pole shaft 55 to close the separable contacts 40 of the circuit breaker 15. The force generated by two closings springs 69, 71 is required as they not only operate the mechanism 53 to close the separable contacts 40, but they also charge the opening spring 65. With the circuit breaker 15 closed as shown in FIG. 6*b*, the release lever 115 is lowered so that if the closing springs 69, 71 are recharged (as shown), the release lever 115 will not engage the closing spring release latch 101 and thus the closing springs 69, 71 cannot be discharged. The closing springs 69, 71 maintain the circuit breaker 15 ready for a recharge should the circuit breaker 15 trip open.

Figure 7C:
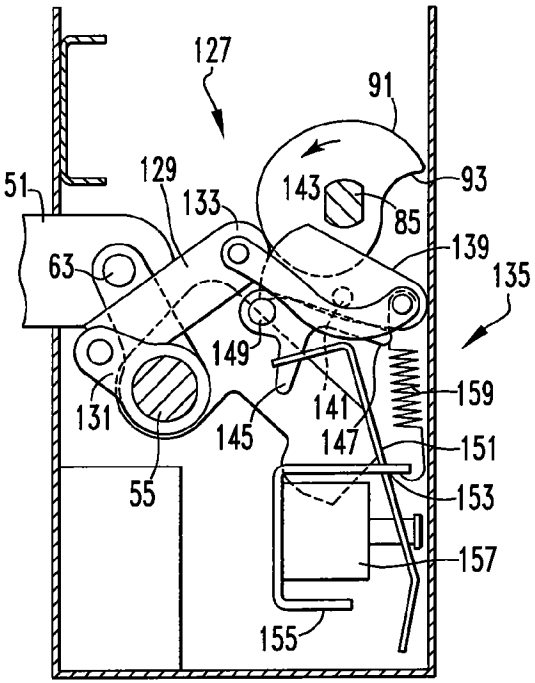
FIG. 7*c* is similar to FIGS. 7*a* and 7*b* but showing the breaker closed and the closing springs discharged.
Figure 7B:
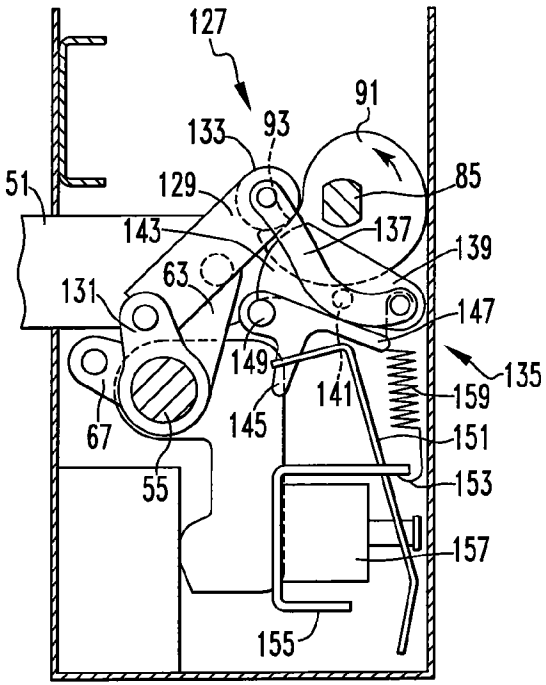
FIG. 7*b* is similar to FIG. 7*a* but showing the breaker in the open position and the closing springs charged.
Figure 7A:
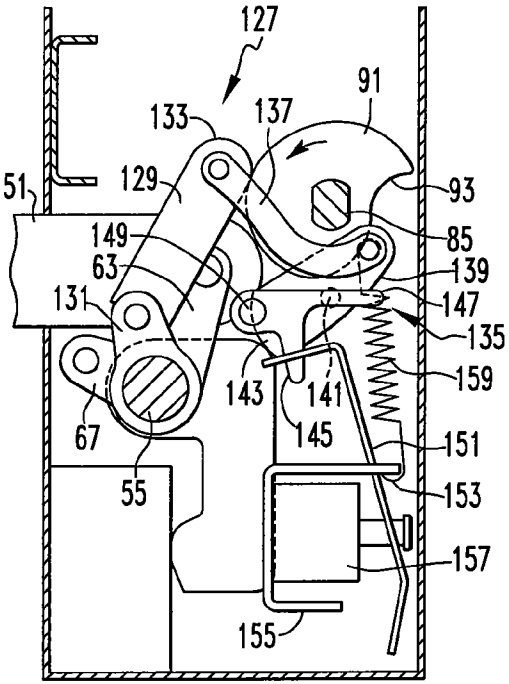
FIG. 7*a* is a sectional view taken along the line 7-7 in FIG. 2 showing the breaker open and the closing spring discharged.

As shown in FIGS. 7*a*-7*c*, the operating mechanism 53 also includes a coupling mechanism 127 for coupling the crank shaft 85 to the pole shaft 55. This coupling mechanism 127 includes a pair of parallel main links 129 each pivotally connected at one end to the pole shaft 55 through a crank arm 131 and rotatably supporting a main link roller 133 between their free ends. This main link roller 133 engages the peripheral surface of the closing cam 91 which, as the crank shaft 85 rotates, pushes on the main links 129 to rotate the pole shaft 55 through the eccentricity in the closing cam 91 surface. Opening spring release mechanism 135 includes a banana link 137 pivoted at one end on a common axis 125 with the main link roller 133 and at the other end to one end of a hatchet 139. The hatchet 139 is mounted on a fixed pivot pin 141 and has a free curved end 143 forming a latch edge 145. Opening spring release mechanism 135 also includes a trip lever 147 fixed to a rotatable trip lever "D" shaft 149. The trip lever 147 is coupled to an opening solenoid assembly 300. The opening solenoid assembly 300 includes an opening solenoid 302 and an opening clapper assembly 304. The opening solenoid 302, preferably, has a mass limit of between about 1.5 kilograms and 2.0 kilograms, and more preferably about 1.89 kilograms. The opening clapper assembly 304 has an elongated body 305 with a first upper end 306 and a second, lower end 308. The trip lever 147 rests on the opening clapper upper end 306. The opening solenoid assembly 300 also includes a bracket 310 which is coupled to the housing 61. The opening clapper assembly 304 is pivotally coupled to the bracket 310 at the opening clapper pivot point 312. The opening clapper pivot point 312 is disposed on a medial location on the opening clapper body 307 (described below). The opening solenoid 302 is also coupled to, or mounted on, the bracket 310. A trip latch reset spring 159 connected to this bracket 310, biases the hatchet 139 clockwise as shown in FIG. 7*a* to the hatchet 139 position as shown in FIGS. 7*b* and 7*c* wherein the latch edge 145 is engaged by the D shaft 149.

FIGS. 7*a*-*c* illustrate the coupling of the crank shaft 85 to the pole shaft 55 to close the circuit breaker 15 and tripping of the opening spring release mechanism 135 to open the circuit breaker 15. FIG. 7*a* illustrates the position of the parts with the circuit breaker 15 open and the closing springs 69, 71 discharged. As can be seen, the push rod 51 is retracted so that the separable contacts 40 are open. The sequence is initiated by operation of the charging mechanism 200 to rotate the crank shaft 85 in the counterclockwise direction to charge the closing springs 69, 71 in the manner described above. The trip latch reset spring 159 biases the main link roller 133 against the peripheral caming surface of the closing cam 91 until it falls into the notch 93 with the closing springs 69, 71 latched in the charged condition. This permits the trip latch reset spring 159 to rotate the hatchet 139 clockwise to the latched position in which the latch edge 145 is engaged by the D shaft 149 as shown in FIG. 7*b*. When the closing spring release 99 is actuated, the closing springs 69, 71 rapidly rotate the crank shaft 85 in the manner described above with reference to FIGS. 6*a* and 6*b*. The increasing effective diameter of the closing cam 91 produced by the eccentricity of the cam 91 surface, pushes the main links 129 downward and to the position shown in FIG. 7*c*. This rotates the pole shaft 55 in the counterclockwise direction to drive the push rod 51 to the left to close the separable contacts 40 while, as can be seen in FIG. 7*c*, the hatchet 139 remains engaged by the D shaft 149.

The circuit breaker 15 is opened manually by pressing on the lower end of the opening clapper assembly 304. In addition, the circuit breaker 15 can be opened automatically by actuation of the opening solenoid 302 which rotates the opening clapper assembly 304 clockwise. The opening solenoid 302 is energized by an electronic trip unit in response to current which exceeds predetermined current/time characteristics. Alternatively, the opening solenoid 302 can be energized from a remote source to open the circuit breaker 15. In any case, rotation of the opening clapper assembly 304 in the clockwise direction rotates the open trip lever 147 and with it the D shaft 149. The force generated by the charged opening spring 65 through the main links 129 and banana link 137 rotates the hatchet 139 counterclockwise past the D shaft 149. This allows the opening spring 65 to rotate the pole shaft 55 to withdraw the push rods 51 and open the separable contacts 40 as the main link roller 133 rolls along the outer surface of the closing cam 91 to the position shown in FIG. 7*a*.

The opening solenoid 302 includes a housing 320, a coil 322 disposed within the opening solenoid housing 320, and an opening clapper assembly 304. The opening clapper assembly 304 has a body assembly 305 with an elongated body 307. The opening clapper assembly 304 is structured to move between a first, extended position and a second, retracted position. The time it takes the opening clapper assembly 304 to move between the first, extended position and the second, retracted position is the response time. As noted above, the response time for the opening solenoid 302 is increased, that is, the speed and/or acceleration of the opening solenoid assembly 300 is slowed, by increasing the mass of the opening clapper assembly 304.

Preferably, the opening clapper assembly 304 and/or the clapper body assembly 305 has a mass that is between about 20% and 30% of the mass limit of the opening solenoid 302, and more preferably, about 25% of the mass limit of the opening solenoid 302. Thus, for an opening solenoid 302 having the mass limit described above, the opening clapper assembly 304 has a mass that is between about 0.38 kilograms and 0.56 kilograms, and more preferably, about 0.48 kilograms. To achieve the increase in mass, the clapper body assembly 305 may be manufactured with the same dimensions/shape as a prior art opening clapper, but be made from a ferrous material that is more dense than what was used in the prior art. Alternatively, the clapper body assembly 305 may be made from the same material and have the same general shape as a prior art clapper, but have an increased dimension, for example, the clapper body 307 may be thicker.

Figure 8:
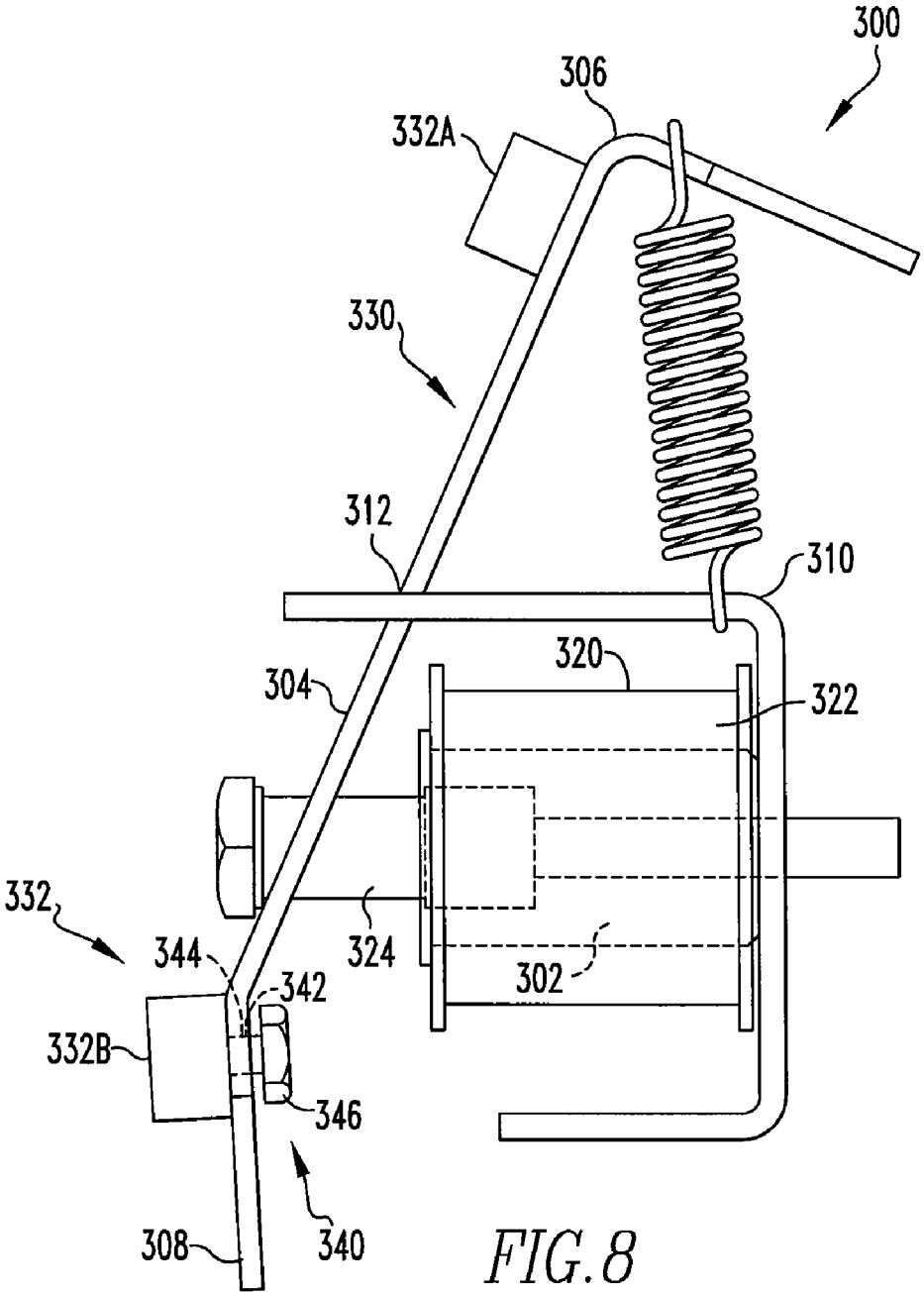
FIG. 8 is a side view of an opening solenoid assembly including a clapper with additional mass.

However, as shown in FIG. 8, in the preferred embodiment the opening solenoid assembly 300 utilizes an clapper body 307 made from the same material and in the same general size/shape as in the prior art, but the clapper body assembly 305 includes additional mass added thereto in the form of one or more slugs 332. The clapper body assembly 305, preferably, has two slugs 332A, 332B disposed on opposite sides of the opening clapper pivot point 312. That is, for an opening solenoid 302 having the mass limit described above, the clapper body 307 has a mass of about 0.2 kilograms and the at least one slug 332, preferably, has about the same mass which is between 0.24 kilograms and 0.32 kilograms, and more preferably, 0.28 kilograms. If there are two slugs 332A, 332B, the slugs 332A, 332B, preferably have about the same mass which totals about 0.28 kilograms. That is, a single slug 332A has a mass of about 0.14 kilograms. Further, the two slugs 332A, 332B are also, preferably, disposed about the same distance from the opening clapper pivot point 312. In this configuration, the balance of the clapper body assembly 305 is comparable to the prior art clapper. As such, the opening solenoid 302 may be the same, or similar, to prior art opening solenoids. By maintaining the same, or substantially similar, operating characteristics, other than the total mass of the clapper body assembly 305, the operation of the opening solenoid assembly 300 is substantially similar, and the components are substantially similar, to the prior art opening solenoid assembly. While this is the preferred embodiment, the invention contemplates other configurations.

That is, by locating the one or more slugs 332 at various distances from the opening clapper pivot point 312 and/or by having one or more slugs 332 on one side of the opening clapper pivot point 312 with a greater mass than the one or more slugs 332 on the opposite side of the opening clapper pivot point 312, the operating characteristics of the opening solenoid 302 may be controlled as desired.

Preferably, the one or more slugs 332 are coupled to the clapper body 307 by a bolted connection such as, but not limited to, a nut and bolt, or, a threaded rod and nut as described below. Other coupling devices include, but are not limited to, brazing the slugs 332 to the clapper body 307, use of other mechanical fasteners, use of adhesives, snap-fit slugs 332 structured to clip onto the opening clapper assembly 304, or welding. A mechanical fastener 340 such as a threaded rod 342 may, for example, be incorporated into the slug 332. In this embodiment, the opening clapper assembly 304 would have one or more openings 344. The opening clapper openings 344 could be threaded so that the slug 332 may be coupled thereto without an additional element, or, the opening clapper openings 344 may be smooth and a nut 346 may be provided. A snap-fit slug 332 may be structured to be movably coupled to the clapper body 307. That is, the slug 332 may be structured to slide longitudinally on the clapper body 307.

With an opening solenoid 302 having a mass limit of about 1.89 kilograms, and an opening clapper assembly 304 having a mass that is about 25% of the opening solenoid 302 mass limit, the response time of the opening solenoid 302 is between 48 ms and 60 ms, and more preferably 50 ms. This response time is delayed relative to the prior art opening solenoids and, as such, the opening solenoid assembly 300 delays the separation of the separable contacts 40 until the direct current wave form of a fault current is off peak.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An opening clapper assembly for a circuit breaker, said circuit breaker having at least one pair of separable contacts and an operating mechanism, said separable contacts structured to move between an open position, wherein the contacts are separated and not in electrical communication and a closed position, wherein the contacts engage each other and are in electrical communication, said operating mechanism coupled to said separable contacts and structured to cause said separable contacts to move between said open position and said closed position, said operating mechanism including an opening solenoid assembly, said opening solenoid assembly structured to actuate said operating mechanism to cause the circuit breaker operating mechanism to open said separable contacts, said opening solenoid assembly having an opening clapper assembly structured to move between a first position and a second position, said opening solenoid assembly having a mass limit, said opening clapper assembly comprising:

a body assembly with an elongated body having a first end, a second end, and a medial pivot point; and said body assembly having a mass of between about 20% and 30% of the mass limit of said opening solenoid assembly.

2. The opening clapper assembly of claim 1 wherein said body assembly has a mass of about 25% of the mass limit of said opening solenoid assembly 3. The opening clapper assembly of claim 1 wherein said body assembly includes at least one slug coupled to said opening clapper body.

4. The opening clapper assembly of claim 3 wherein:

said at least one slug includes a first slug and a second slug;

said first slug coupled to said opening clapper body first end; and said second slug coupled to said opening clapper body second end.

5. The opening clapper assembly of claim 4 wherein said opening solenoid assembly includes a bracket and wherein:

said opening clapper body is pivotally coupled to said opening solenoid assembly bracket at said opening clapper body pivot point; and said first slug and said second slug are each disposed about an equal distance from said opening clapper body pivot point.

6. The opening clapper assembly of claim 3 wherein said at least one slug is brazed to said opening clapper body.

7. The opening clapper assembly of claim 3 wherein:

said opening clapper body includes one or more openings; and said at least one slug is coupled to said opening clapper body by a mechanical fastener at one of said opening clapper body one or more openings.

8. The opening clapper assembly of claim 3 wherein said at least one slug is movably coupled to said opening clapper body and is structured to slide longitudinally on said opening clapper body.

9. The opening clapper assembly of claim 3 wherein said opening solenoid assembly has a mass limit of about 1.89 kilograms and wherein:

said opening clapper body has a mass of about 0.2 kilograms; and said at least one slug has a mass of about 0.28 kilograms.

10. An opening solenoid assembly for a circuit breaker, said circuit breaker having at least one pair of separable contacts and an operating mechanism, said separable contacts structured to move between an open position, wherein the contacts are separated and not in electrical communication and a closed position, wherein the contacts engage each other and are in electrical communication, said operating mechanism coupled to said separable contacts and structured to cause said separable contacts to move between said open position and said closed position, said opening solenoid assembly comprising:

an opening solenoid and an opening clapper assembly;

said opening solenoid assembly structured to actuate said operating mechanism to cause the circuit breaker operating mechanism to open said separable contacts, said opening solenoid assembly having an opening clapper assembly structured to move between a first position and a second position, said opening solenoid assembly having a mass limit;

said opening clapper assembly having an elongated body with a first end, a second end, and a medial pivot point, said opening clapper body having a mass of between about 20% and 30% of the mass limit of said opening solenoid assembly; and said opening clapper assembly body coupled to said operating mechanism.

11. The opening solenoid assembly of claim 10 wherein said opening clapper body has a mass of about 25% of the mass limit of said opening solenoid assembly.

12. The opening solenoid assembly of claim 10 further comprising at least one slug coupled to said opening clapper body.

13. The opening solenoid assembly of claim 12 wherein:

said at least one slug includes a first slug and a second slug;

said first slug coupled to said opening clapper body first end; and said second slug coupled to said opening clapper body second end.

14. The opening solenoid assembly of claim 13 wherein said opening solenoid assembly includes a bracket and wherein:

said opening clapper body is pivotally coupled to said opening solenoid assembly bracket at said opening clapper body pivot point; and said first slug and said second slug are each disposed about an equal distance from said opening clapper body pivot point.

15. The opening solenoid assembly of claim 12 wherein said at least one slug is brazed to said opening clapper body.

16. The opening solenoid assembly of claim 12 wherein:

said opening clapper body includes one or more openings; and said at least one slug is coupled to said opening clapper body by a mechanical fastener at one of said opening clapper body one or more openings.

17. The opening solenoid assembly of claim 12 wherein said at least one slug is movably coupled to said opening clapper body and is structured to slide longitudinally on said opening clapper body.

18. The opening solenoid assembly of claim 12 wherein:

said opening solenoid assembly has a mass limit of about 1.89 kilograms;

said opening clapper body has a mass of about 0.2 kilograms; and said at least one slug has a mass of about 0.28 kilograms.

19. A circuit breaker comprising:

at least one pair of separable contacts, an operating mechanism, and an opening solenoid assembly;

said separable contacts structured to move between an open position, wherein the contacts are separated and not in electrical communication and a closed position, wherein the contacts engage each other and are in electrical communication;

said operating mechanism coupled to said separable contacts and structured to cause said separable contacts to move between said open position and said closed position;

said opening solenoid assembly having an opening solenoid and an opening clapper assembly;

said opening solenoid assembly structured to actuate said operating mechanism to cause the circuit breaker operating mechanism to open said separable contacts, said opening solenoid assembly having an opening clapper assembly structured to move between a first position and a second position, said opening solenoid assembly having a mass limit of about 1.89 kilograms;

said opening clapper assembly having an elongated body with a first end, a second end, and a medial pivot point, said opening clapper body having a mass of between about20% and 30% of the mass limit of said opening solenoid assembly; and said opening clapper assembly body coupled to said operating mechanism.

20. The circuit breaker of claim 19 wherein said opening clapper body has a mass of about 25% of the mass limit of said opening solenoid assembly.

* * * * *